United States Patent [19]

Bonner

[11] Patent Number: 4,563,560

[45] Date of Patent: Jan. 7, 1986

[54] MICROWAVE OVEN CONSTRUCTION

[75] Inventor: Howard E. Bonner, Winnetka, Ill.

[73] Assignee: Litton Systems, Inc., Beverly Hills, Pa.

[21] Appl. No.: 387,723

[22] Filed: Jun. 11, 1982

[51] Int. Cl.[4] ..... H05B 6/64

[52] U.S. Cl. ..... 219/10.55 D; 220/4 B; 220/4 R

[58] Field of Search ..... 219/10.55 D, 10.55 R, 219/385, 391, 409; 29/512, 523; 126/273 R, 273 A, 19 R, 21 A, 275 R, 275 E; 220/4 B, 4 R, 76

[56] References Cited

U.S. PATENT DOCUMENTS

| | | | |
|---|---|---|---|
| 1,492,909 | 5/1924 | Waizenegger | 126/19 R |
| 1,815,312 | 7/1931 | Heise | 126/275 R |
| 2,557,496 | 6/1951 | Brodbect | 126/19 R |
| 3,484,573 | 12/1969 | Tingley | 219/10.55 D |
| 3,544,751 | 12/1970 | Valles | 219/10.55 D |

FOREIGN PATENT DOCUMENTS

| | | | |
|---|---|---|---|
| 7441834 | 6/1976 | Fed. Rep. of Germany . | |
| 909009 | 10/1962 | United Kingdom | 219/10.55 D |

OTHER PUBLICATIONS

United States Steel Publications: "Energy Saving Solutions in Steel from U.S. Steel"; Apr. 1979.

*Primary Examiner*—C. L. Albritton
*Assistant Examiner*—M. M. Lateef
*Attorney, Agent, or Firm*—John M. Haurykiewicz; Walter R. Thiel

[57] ABSTRACT

A microwave oven construction is disclosed wherein the oven cavity is assembled without the use of structural welds. A pair of pan shaped members, one forming the oven cavity top and the other forming the oven cavity bottom are placed edge to edge and crimped together to form a unitary cavity structure. An oven front panel is crimped to the cavity structure thus formed.

6 Claims, 3 Drawing Figures

MICROWAVE OVEN CONSTRUCTION

BACKGROUND OF THE INVENTION

This invention relates to the field of microwave ovens, and more particularly to the construction of the microwave oven cavity. Cooking appliances utilizing energy in the microwave frequency spectrum are well known. One problem with such appliances is the need to insure that microwave energy does not escape from the cooking cavity, and in fact, government regulations prescribe the maximum amounts of microwave energy which can be allowed to escape. Microwave oven cavities are generally box like in shape and made up of a plurality of side, top, bottom, and back panels welded together. Many workers in the field have endeavored to reduce the number of parts to a minimum in order to reduce cost and facilitate manufacturing.

Prior art patents which disclose known techniques for the construction of microwave oven cavities include U.S. Pat. Nos. 3,867,605; 4,107,502; 4,163,141; 4,192,431; and 4,282,416. Each of these patents, with the exception of U.S. Pat. No. 3,867,605, discloses a microwave oven cavity in which the various sides are either welded or fastened together. U.S. Pat. No. 3,867,605 shows a microwave oven having a very small drawn aluminum cavity.

SUMMARY OF THE INVENTION

The present invention discloses a method for manufacturing a full size microwave oven cavity without the use of structural welds. The cavity is assembled using metal crimping techniques in order to achieve a simple, easy to assemble, low cost microwave oven structure.

The microwave oven cavity of the present invention consists of a top half and a bottom half each of which have been drawn to the size and shape desired and each of which has a peripheral flange or edge. The top and bottom halves are joined in edge-to-edge relationship by crimping the flanges together. One side of each top and bottom half is left open to form the front of the oven. A front panel is crimped to the cavity to complete the assembly.

DESCRIPTION OF PREFERRED EMBODIMENTS

Figure 1:
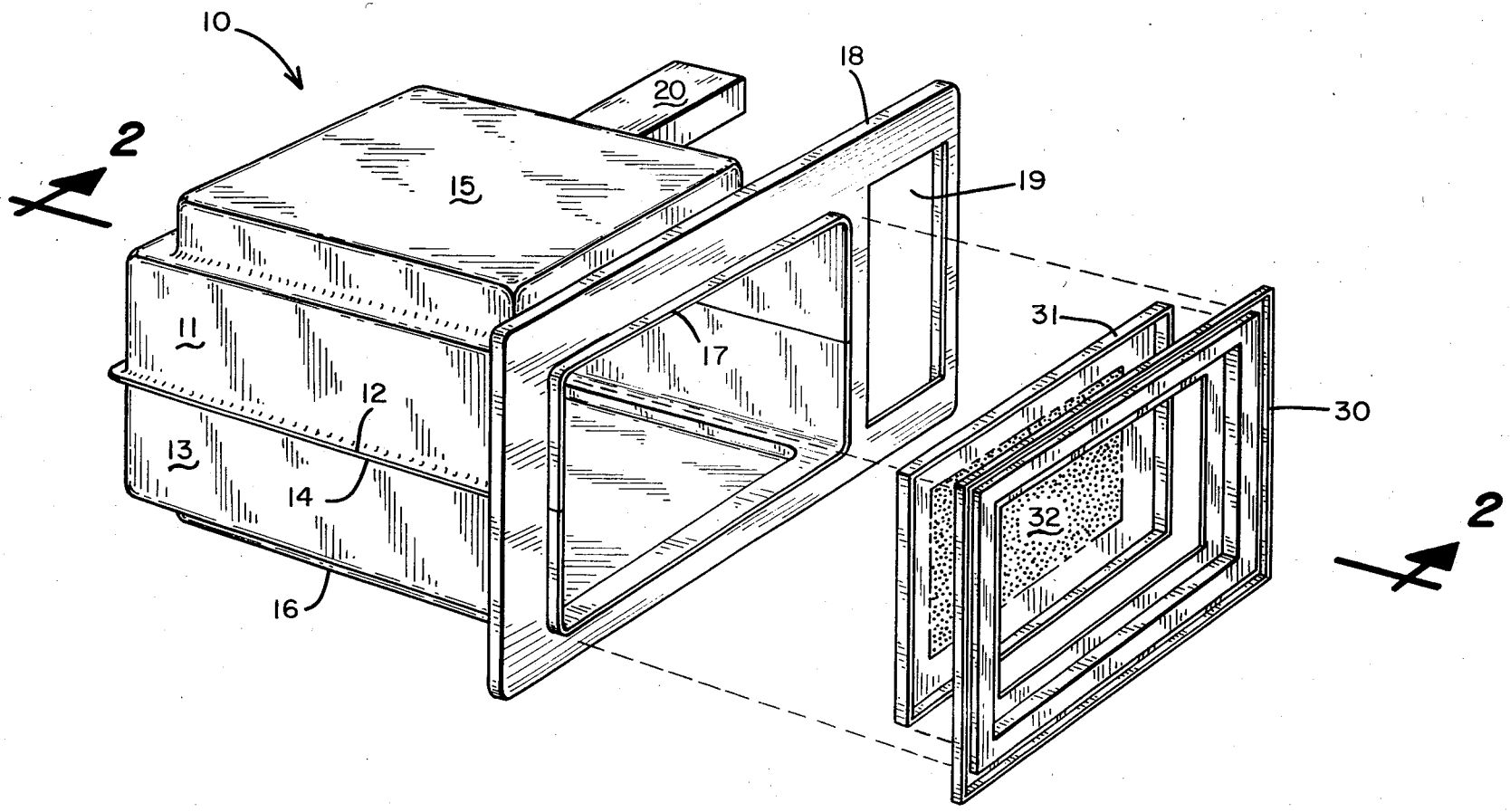
FIG. 1 is a perspective view of the microwave oven cavity in assembled form showing the oven door in detached exploded fashion.

The invention is illustrated generally in FIG. 1. A microwave oven cavity assembly 10 is formed by a top portion 11 and a bottom portion 13 which have been joined together. The top portion 11 is a generally pan shaped unitary piece having a peripheral edge 12.

The top portion 11 is formed from a suitable material, such as cold rolled steel, preferably by drawing. Included as part of top portion 11 is an energy distribution chamber 15 which as shown in FIG. 1 is drawn as an integral part. While this is the preferred construction, it would be possible to provide an opening in the upper wall of top portion 11 and attach the energy distribution chamber 15 separately by welding or crimping techniques.

The lower portion 13 is similarly a unitary drawn part having integrally molded therein the lower well 16. The lower well 16 serves as the electrical bottom of the oven cooking cavity. In use a glass or other microwave permeable material in the form of a shelf will be laid on top of the well 16 for cooking purposes. Lower portion 13 includes a peripheral edge 14.

Figure 2:
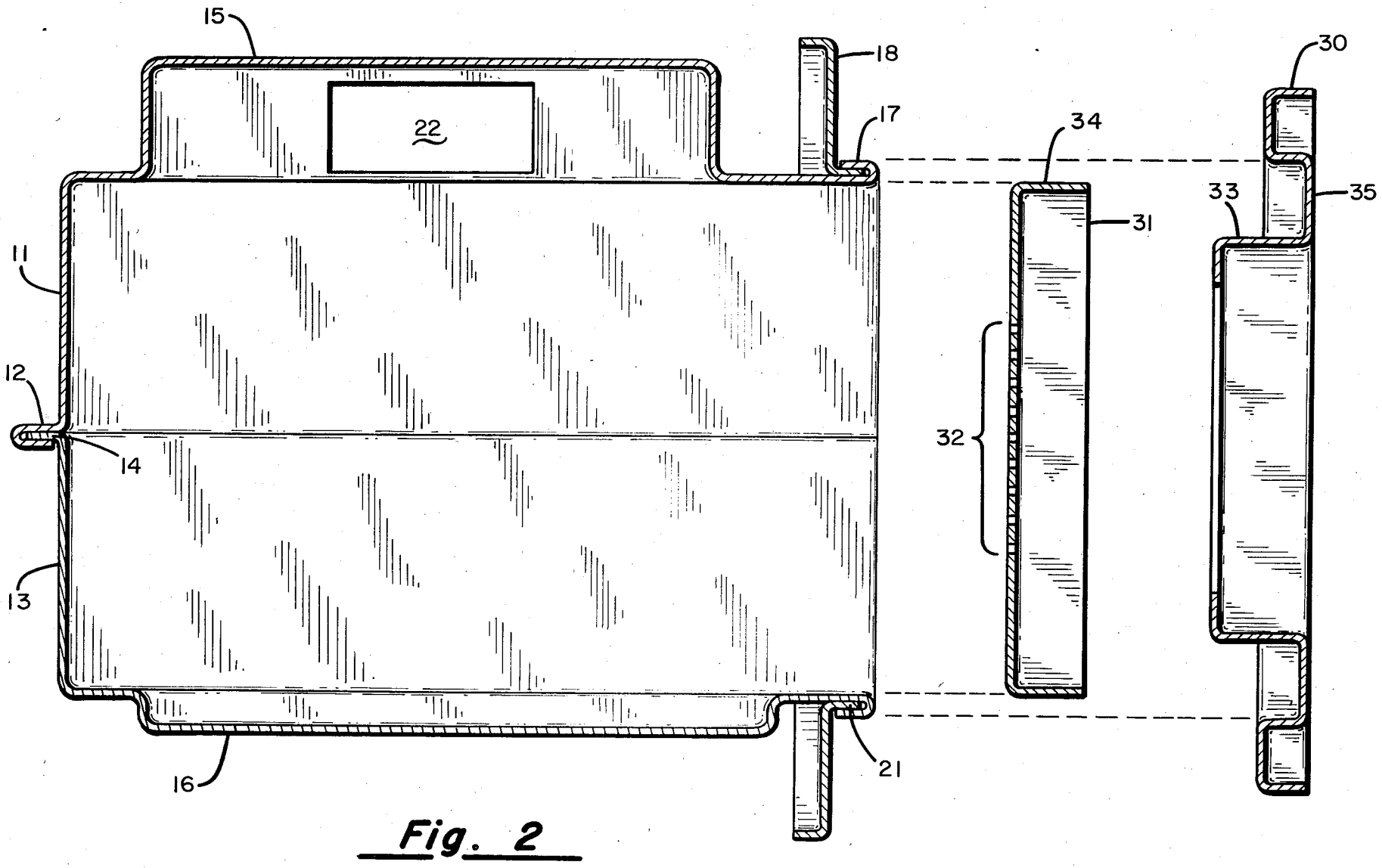
FIG. 2 is a cross-sectional view taken along line 2—2 in FIG. 1.

As best shown in FIG. 2, the upper and lower portions are brought into contact along their respective peripheral edges 12 and 14. The two halves are then assembled together by crimping one peripheral edge about the other. A variety of known crimping techniques can be employed to form the seam such as rolling or crimping. In the construction shown in FIG. 2 the crimp consists of peripheral edge 12 being rolled around peripheral edge 14 in a U shape. However other shapes can be used which would involve deforming both peripheral edge 12 and peripheral edge 14.

The top porton 11 and the bottom portion 13 are seamed together around three sides leaving the fourth side open to serve as the front of the oven. A front panel 18 having an opening corresponding in dimension and shape to the front opening formed by the upper and lower portions of the cavity is slipped on to the front of the cavity in a collar like fashion. The front panel 18 includes a forwardly facing flange 21. Once the front panel 18 has been slipped onto the cavity assembly a sufficient distance so that the front edge 17 of the cavity assembly extends forwardly of the flange 21, the front edge 17 is crimped around the flange 21 to secure the front panel 18 to the cavity assembly. A cut-out portion 19 is provided in the front panel for mounting of microwave oven controls.

The energy distribution chamber 15 is provided with an aperture 22 for receiving a waveguide 20 through which microwave energy may be transmitted to the energy distributing chamber 15.

A microwave oven door suitable for use with the described cavity structure consists of an outer portion 30 and an inner portion 31. Each of these pieces 30 and 31 can be formed in a single pressing operation, with the inner portion 31 being thereafter attached to the outer portion 30 by welding or other suitable fastening technique. Perforations 32 are made in the central portion of the inner piece 31 in order to provide a viewing screen through the oven door.

Figure 3:
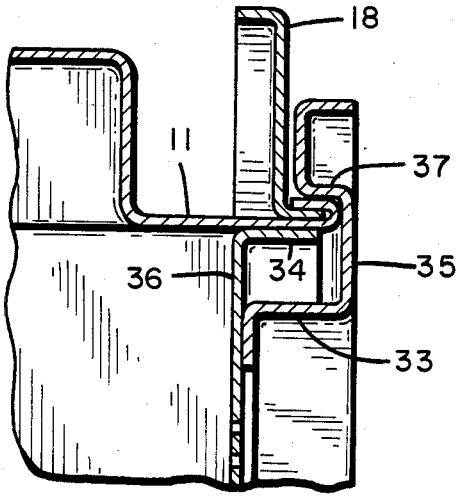
FIG. 3 is an enlarged cross section showning the oven door in the closed position.

With particular reference to FIG. 3 it can be seen that a quarter wave choke chamber is formed in the door by horizontal surface 33 and vertical surface 35 of outer door portion 30 and by horizontal flange 34 and vertical wall 36 of inner door portion 31. Quarter wave chokes of this type are well known in the art and need not be further described at this point.

However as also illustrated in FIG. 3 showing the microwave cavity assembly with the door in the closed position, the forwardly projecting flange formed by the crimping of front panel flange 21 and edge 17 is sized and positioned to be located between horizontal flange 34 and wall 37. In effect the inner door portion 31 is inserted into the cavity 10 when the door is closed. This construction provides for an extremely reliable microwave energy seal.

It will be understood that the parts illustrated in the drawings consist of the basic structural portions of the microwave oven cavity and door assembly. In addition to the parts shown, the completed microwave oven would include electrical and mechanical operating parts as well as a decorative outer wrap, and an esthetically pleasing outer door cover. Since these portions do not constitute part of the present invention they are not illustrated in the drawings.

The microwave oven cavity assembly illustrated and described provides an assembly which is economical to manufacture in that the use of structural welds have been eliminated. The assembly derives its structural integrity from the crimped seams found around the peripheral edges of the top and bottom portions of the cavity and around the front peripheral edge between the cavity and the front panel. These crimped seams, the first running in a generally horizontal plane and the second running in a generally vertical plane provide a structurally sound apparatus. Because the top and bottom portions of the cavity are drawn, the top portion can include an integral energy distributing chamber as part of the draw tooling, and the lower half can include a cavity bottom well as an integral part of the draw tooling. This precludes the need to form either of the parts in a separate operation or to add them by welding. The use of the crimp seam to attach the front panel to the cavity provides the additional advantage of the forwardly protruding flange to mate with the door choke to provide a reliable inserted choke type of construction.

While the invention has been described in considerable detail in the foregoing specification it will be understood that the detail is provided for purposes of completeness and not by way of limitation, as variations may occur to those skilled in the art.

What is claimed:

1. In a microwave oven having an oven cavity assembly including a source of microwave energy fed into said microwave oven cavity assembly, said microwave oven cavity assembly being substantially free of structural welds, said assembly comprising only two members:

(a) the first member formed as a unitary pan-like member having a well portion integrally formed therein, said first member comprising a bottom wall and portions of side and rear walls of a microwave oven cavity;

(b) the second member formed as a unitary pan-like member comprising a top wall and portions of side and rear walls of a microwave oven cavity; and wherein said first and second members are permanently joined together at respective abutting peripheral side and rear wall edges by tightly crimping one such edge about the other to form a microwave oven cavity having bottom, top, side, and rear walls and which is substantially enclosed on all but a front wall thereof.

2. The assembly of claim 1 in combination with a front panel completely encircling the unclosed front wall of said oven cavity, said front panel being fixed to said cavity by tightly crimping a cavity edge to said front panel in a continuous seam between said cavity front wall and said front panel.

3. The assembly of claim 1 wherein said first member further comprises a lower portion of a microwave oven cavity that is free of seams at the lowest plane thereof.

4. The assembly of claim 1 wherein said second pan like member has an energy distributing chamber integrally formed therein.

5. The assembly of claim 2 wherein said front panel includes a forwardly extending flange and said cavity front wall includes an edge which is tightly crimped to said flange.

6. The assembly of claim 3 further including a door having a microwave choke therein and wherein said forwardly extending flange is inserted into said choke when said door is closed.

* * * * *